US006792708B2

(12) United States Patent
Dicke et al.

(10) Patent No.: US 6,792,708 B2
(45) Date of Patent: Sep. 21, 2004

(54) LIGHTWEIGHT COLLAPSIBLE SIGN

(75) Inventors: Grant D. Dicke, Downers Grove, IL (US); James G. Kokenas, Westmont, IL (US); Donald E. Hans, Romeoville, IL (US)

(73) Assignee: Dicke Tool Company, Downers Grove, IL (US)

( * ) Notice: Subject to any disclaimer, the term of this patent is extended or adjusted under 35 U.S.C. 154(b) by 0 days.

(21) Appl. No.: 10/438,041

(22) Filed: May 14, 2003

(65) Prior Publication Data

US 2003/0217496 A1 Nov. 27, 2003

Related U.S. Application Data

(62) Division of application No. 09/798,681, filed on Mar. 2, 2001, now Pat. No. 6,625,912.

(51) Int. Cl.[7] ..... G09F 15/00
(52) U.S. Cl. ..... 40/610; 40/607.01; 248/548
(58) Field of Search ..... 248/548; 52/98; 40/610, 607.01, 607.04, 607.1

(56) References Cited

U.S. PATENT DOCUMENTS

| | | | | |
|---|---|---|---|---|
| 3,628,296 A | | 12/1971 | Henry | |
| 4,201,975 A | | 5/1980 | Marcus | |
| 4,232,466 A | | 11/1980 | Mathis | |
| 4,236,843 A | | 12/1980 | Chisholm | |
| 4,490,062 A | | 12/1984 | Chisholm | |
| 4,548,379 A | | 10/1985 | Seely et al. | |
| 4,569,499 A | | 2/1986 | Seely | |
| 4,593,879 A | | 6/1986 | Seely et al. | |
| 4,676,015 A | | 6/1987 | Stoudt | |
| 4,813,199 A | | 3/1989 | Lewis, Jr. | |
| 4,920,715 A | | 5/1990 | Parsons et al. | |
| 4,980,984 A | | 1/1991 | Kulp et al. | |
| 5,060,437 A | | 10/1991 | Parsons et al. | |
| 5,094,023 A | | 3/1992 | McVey | |
| 5,318,258 A | | 6/1994 | Lang | |
| 5,340,068 A | | 8/1994 | Sarkisian et al. | |
| 5,422,638 A | | 6/1995 | Singer et al. | |
| 5,480,121 A | | 1/1996 | Rice et al. | |
| 5,667,175 A | | 9/1997 | Brady | |
| 5,794,910 A | | 8/1998 | Granger | |
| 5,855,443 A | * | 1/1999 | Faller et al. | 403/2 |
| 5,887,842 A | | 3/1999 | Granger | |
| 5,931,724 A | | 8/1999 | Perlov et al. | |
| 5,957,425 A | | 9/1999 | Conway et al. | |
| 6,216,413 B1 | * | 4/2001 | Lapointe | 52/726.3 |
| 6,237,268 B1 | | 5/2001 | Levin | |
| 6,254,063 B1 | * | 7/2001 | Rohde et al. | 256/13.1 |
| 6,315,251 B1 | | 11/2001 | Stoudt et al. | |
| 6,467,747 B1 | | 10/2002 | Ellsworth | |
| 6,560,906 B1 | | 5/2003 | Hillstrom | |
| 2002/0121035 A1 | | 9/2002 | Dicke et al. | |
| 2002/0121036 A1 | | 9/2002 | Dicke et al. | |

* cited by examiner

*Primary Examiner*—Joanne Silbermann
(74) *Attorney, Agent, or Firm*—Fitch, Even, Tabin & Flannery

(57) ABSTRACT

The invention provides a portable, collapsible sign stand assembly in which a sign is suspended from a support tube. The support tube is connected to a support base through a connecting member which includes a plurality of weakening members which cause the connecting member to fail upon impact. In other embodiments, the support tube is weakened by weakening members so as to fail upon impact. In one embodiment, the weakened portions are placed under tension.

8 Claims, 16 Drawing Sheets

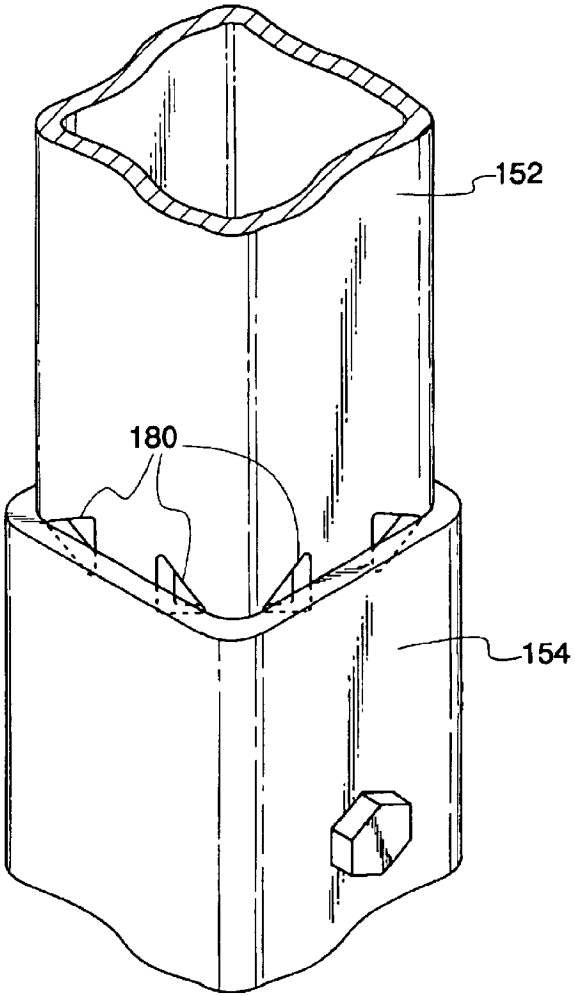
Fig. 27
Fig. 26
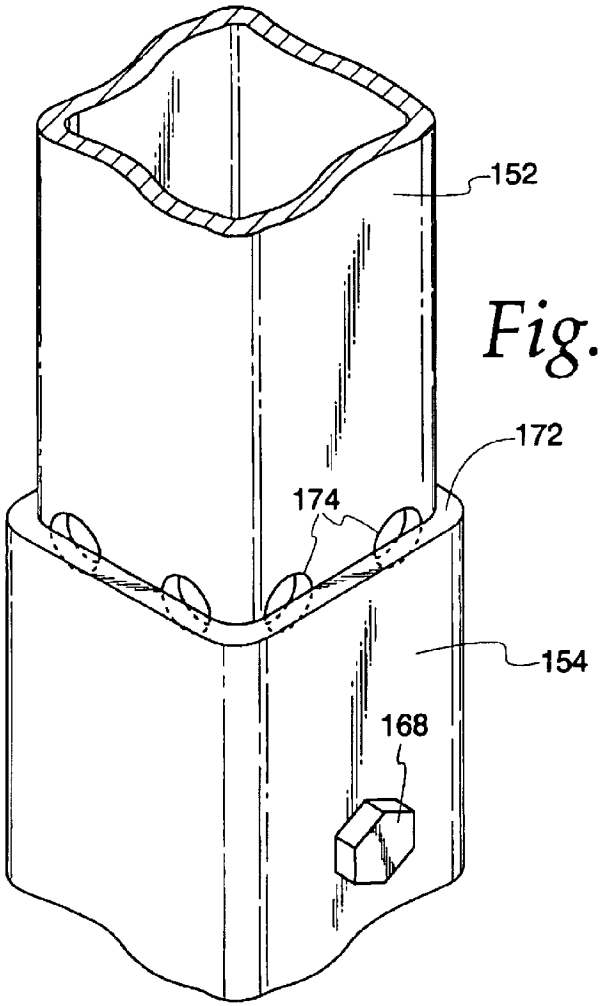

LIGHTWEIGHT COLLAPSIBLE SIGN

This is a division, of prior application Ser. No. 09/798,681, filed Mar. 2, 2001, now U.S. Pat. No. 6,625,412 which is hereby herein by reference in its entirety. The entire disclosure of the prior application, from which a copy of the oath or declaration is supplied under paragraph 3 below, is considered as being part of the disclosure of the accompanying application, and is hereby incorporated by reference therein.

BACKGROUND OF THE INVENTION

1. Field of the Invention

The present invention pertains to signs such as temporary warning signs which may be collapsed for storage in a reduced space and readily erected upon demand.

2. Description of Related Art

Warning signs are provided for a variety of purposes. Among the more demanding applications, is the use of roadside warning signs to advise motorists and pedestrians of activity being conducted at a work site. This type of signage allows those present in the vicinity to be alerted before entering the center of the work area so that appropriate action may be taken. Such signs are used, for example, by utility companies and others who maintain dedicated service in residential areas, and who may be required to perform repairs and other work activities in close proximity to pedestrian or vehicular traffic. With the presence of appropriate warning signs, pedestrian traffic is advised that objects unusual for the area may impede their progress of movement, that objects may be temporarily suspended above them or that other conditions may warrant careful scrutiny while traversing a work area. Vehicular traffic approaching a work site can, with sufficient amounts of properly located signage, be advised that traffic is being diverted or that traffic may be required to stop or slow down to avoid contact with workmen or construction vehicles, for example.

For long term projects, appropriate signage can be ordered ahead of time and installed in a permanent or semi-permanent fashion, after a detailed study of the particular work area. However, utility companies, highway departments, providers of emergency services and others may be required to establish a work area, virtually on a moment's notice. For example, management of a traffic accident scene may require appropriate signage to be erected in a traffic lane or at a roadside or other location, on an emergency basis.

Bearing in mind that such signage must be large enough to present adequate notice to motorists and others passing by an area, consideration of the sign's size and weight must be taken into account when outfitting a work team. It is impractical in such instances to require work personnel to employ bulky, massive signage. Accordingly, lightweight so-called "roll-up" signs are becoming increasingly popular with a variety of different users. With lightweight collapsible signs, utility construction or repair crews can carry a number of such signs as standard equipment which is maintained in the vehicles at all times.

One example of a commercially popular collapsible sign panel is the Model No. 3000XP sign panels offered for sale by the assignee of the present invention. The collapsible sign panel employs aluminum tubing arms and a central mounting system which allows the panel to fold together before rolling into a compact bundle that is more easily stored in tight places. The sign panels are made of flexible retroreflective material which is folded as the arms are pivoted about the hub. The flexible panel is then wound about the collapsed arms to form a compact, cylindrical package of minimal size. Sign panels which are as large as three feet and four feet on a side are typical.

U.S. Pat. No. 4,694,601 assigned to the assignee of the present invention shows a portable collapsible sign which has also enjoyed commercial success. Various sign stand assemblies employ spring loading features to balance wind deflection forces. Ground-engaging legs for supporting the erected sign panel may be permanently attached to the sign panel or may be provided in a separate assembly which is typically mated to the erected sign panel with a slip fit or other type of engagement.

With easily portable sign panel assemblies of the above-described type, the use of signage at temporary workplace locations is becoming more consistent due to the practicality and ease of use afforded worksite personnel. However, further improvements are still being sought. For example, continued improvements and simplifications of the sign assembly mechanisms are continually being sought.

The Transportation Research Board (TRB) is a unit of the National Research Council, a private, nonprofit institution that is the principal operating agency of the National Academy of Sciences (established by Congress in 1863) and the National Academy of Engineering. The mission of the Transportation Research Board is to promote innovation and progress in transportation by stimulating and conducting research, facilitating the dissemination of information, and encouraging the implementation of research results.

The Transportation Research Board fulfills its mission through the work of its standing technical committees and task forces addressing all modes and aspects of transportation. Duties include conducting special studies on transportation policy issues at the request of the U.S. Congress and government agencies as well as operation of an on-line computerized file of transportation research information and the hosting of an annual meeting that attracts a large number of transportation professionals from throughout the United States and abroad.

The Transportation Research Board administers two cooperative research programs: The first program, the National Cooperative Highway Research Program (NCHRP) is sponsored by the member departments of the American Association of State Highway and Transportation Officials in cooperation with the Federal Highway Administration, the National Cooperative Highway Research Program and the Transit Cooperative Research Program. The National Cooperative Highway Research Program was created in 1962 as a means of conducting research in acute problem areas that affect highway planning, design, construction, operation, and maintenance nationwide.

The second program, named the Transit Cooperative Research Program (TCRP), is sponsored by the Federal Transit Administration and is carried out under a three-way agreement among the National Academy of Sciences (acting through the Transportation Research Board), the Transit Development Corporation, Inc. (a nonprofit educational and research organization established by the American Public Transportation Association) and the Federal Transit Administration. The Transit Cooperative Research Program serves as one of the principal means by which the transit industry can develop innovative near-term solutions to meet demands placed on public transit systems.

Currently, developers of roadside safety hardware are guided by testing requirements using a range of criteria defined by Report 350 of the National Cooperative Highway Research Program (NCHRP), entitled "Recommended Procedures for the Safety Performance Evaluation of Highway Features." NCHRP Report 350, incorporated significant changes and additions to procedures for safety performance evaluation, including criteria for multiple performance levels, guidelines for testing features not previously addressed, translation to metric units, and updates reflecting the changing character of the highway network and the vehicles using it. Concerns have been raised that some existing hardware, which is observed to be performing adequately in the field, may have difficulty passing new tests and evaluation criteria. Further study and testing has been called for in an attempt to improve roadside safety by establishing crashworthiness criteria that reflects changes to the vehicle fleet and safety hardware technology.

In its Jul. 25, 1997 guidance memo, "Identifying Acceptable Highway Safety Features," the Federal Highway Administration established four categories of work zone devices. It also set deadlines requiring devices within each category to be crashworthy under the National Cooperative Highway Research Program Report 350 criteria.

Work crews, such as those servicing and installing utility equipment, are required to operate at or near operational highways and other roadways. Temporary sign assemblies are typically carried by the work crew and are installed at a roadside location so as to give oncoming motorists time to react to the unexpected appearance of equipment and personnel, at or near the highway roadside. At times, a work crews operations will be very brief. Nonetheless, it is important that roadside warnings in accordance with recent safety regulations, be set up in advance of work commencement. To be commercially successful, a temporary sign assembly must be capable of quick and easy deployment.

SUMMARY OF THE INVENTION

It is an object of the present invention to develop temporary sign assemblies that are good candidates for offering a satisfactory performance when tested under various safety programs.

It is another object of the present invention to provide sign panel assemblies having an improved ease of operation, with low mass, conformable, dynamically reconfigurable members.

A further object of the present invention is to make it possible for police vehicles, survey teams and others which typically employ automobile and other similar sized vehicles to carry several signs in the trunks of their vehicles. These and other objects of the present invention are provided in a support arrangement, a base, a force accumulator tube of hollow predetermined cross-section outwardly extends from the base and has a free edge spaced from the base. A support tube of hollow complementary cross-section telescopically engages in a close-sized fit with force accumulator tube so as to have a predetermined portion which extends beyond the free edge of force accumulator tube. An insertion limiter cooperates with force accumulator tube and support tube to limit telescopic engagement of support tube and force accumulator tube, aligns with predetermined portion with the free edge of force accumulator tube, and predetermined portion of support tube includes a plurality of weakening members aligned with the free edge of force accumulator tube. A lateral force applied to sign support arrangement is accumulated at free edge of force accumulator tube and is developed at predetermined portion of support tube.

Other objects are attained in a support arrangement, a base plate, a force accumulator tube of hollow predetermined cross-section depends from base plate, force accumulator having a free edge spaced from the base plate, support tube of hollow complementary cross-section, has a lower edge. A support plate at the bottom of support tube, support plate spaced from base plate to form a gap therewith. A tension arrangement extends between base plate and support plate, urging said base plate and support plate away from one another, a connecting tube having opposed ends telescopically engaged in a close-sized fit with force accumulator tube and support tube, and spanning the gap between support plate and base plate first and second insertion limiters cooperating with force accumulator tube, connecting tube and support tube to limit telescopic engagement of connecting tube and force accumulator tube limiting telescopic engagement of support tube and force accumulator tube, aligning a predetermined portion of connecting tube with a force accumulator tube free edge, and predetermined portion of connecting tube including a plurality of weakening members aligned with the free edge of force accumulator tube. A lateral force applied to sign support arrangement is accumulated at the free edge of force accumulator tube and is developed at predetermined portion of connecting tube.

BRIEF DESCRIPTION OF THE DRAWINGS

FIG. 26 shows an indicated portion of the sign stand assembly of FIG. 24, on an enlarged scale;

FIGS. 27 and 28 show alternative embodiments of the sign stand assembly of FIG. 24.

DETAILED DESCRIPTION OF THE PREFERRED EMBODIMENTS

Figure 1:
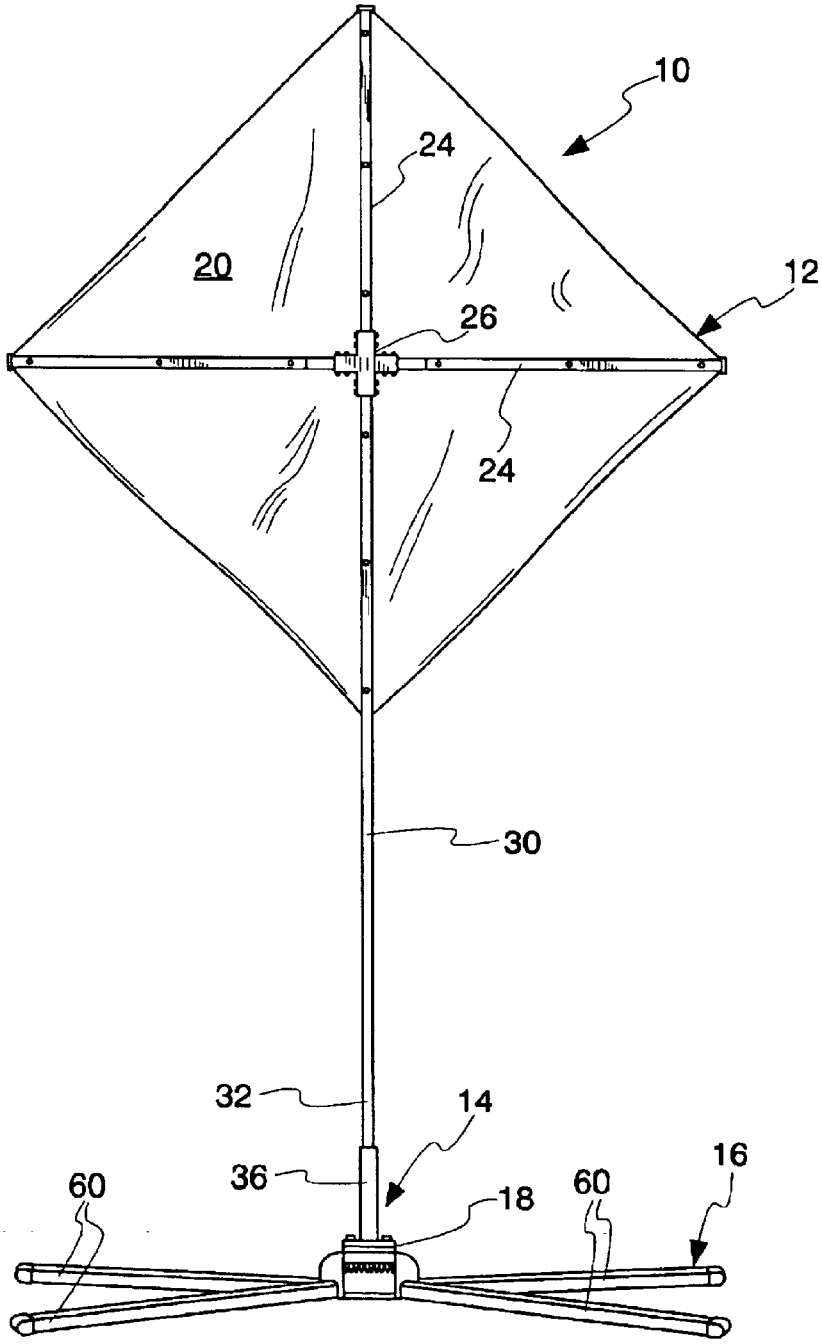
FIG. 1 is a perspective view of a sign and sign stand assembly according to principles of the present invention.

Turning now to the drawings, FIG. 1 shows a sign apparatus generally indicated at 10. Included is a sign panel assembly 12 supported by a sign stand assembly 14 having ground-engaging legs 16 and a spring-loaded pivoting coupling 18. The sign panel assembly 12 includes a flexible message or sign panel 20 of conventional construction. Sign panel 20 may, for example, comprise a mesh fabric such as vinyl coated polyester mesh or may be of a solid or continuous such as a vinyl coating applied to a polyester fabric backing. It is generally preferred that the sign panel 20 be made of some sort of reflective material, such as a vinyl microprism reflective material so as to provide a high level of retro-reflectivity of a type suitable for traffic applications.

Federally mandated standards are being developed to ensure that roadside appurtenances such as temporary warning signs are crashworthy under the National Cooperative Highway Research Program Report 350 criteria. Category II Devices are defined as not being expected to produce significant vehicular velocity change, but may otherwise be hazardous. The following is a SUMMARY OF SUPPLEMENTARY EVALUATION FACTORS for crash worthiness according to the National Cooperative Highway Research Program Report 350 criteria:

Passenger Compartment Intrusion

1. Windshield Intrusion
   a. No windshield contact
   b. Windshield contact, no damage
   c. Windshield contact, no intrusion
   d. Device embedded in windshield, no significant intrusion
   e. Partial intrusion into passenger compartment
   f. Complete intrusion into passenger compartment
2. Body Panel Intrusion (yes or no)

Loss of Vehicle Control

1. Physical loss of control
2. Loss of windshield visibility
3. Perceived threat to other vehicles from debris
4. Debris on pavement Physical Threat to Workers or Other Vehicles 1. Harmful debris that could injure workers (yes or no)
2. Harmful debris that could injure workers in other vehicles (yes or no)

If yes, record the size and approximate mass of the debris, the approximate speed (high or low) and the approximate trajectory (height, direction etc.) of the potentially harmful debris.

Vehicle and Device Condition

1. Vehicle Damage
   a. None
   b. Minor scrapes, scratches or dents
   c. Significant cosmetic dents
   d. Major dents to grill and body panels
   e. Major structural damage
2. Windshield Damage
   a. None
   b. Minor chip or crack
   c. Broken, no interference with visibility
   d. Broken and shattered, visibility restricted but remained intact
   e. Shattered, remained intact but partially dislodged
   f. Large portion removed
   g. Completely removed
3. Device Damage
   a. None
   b. Superficial
   c. Substantial, but can be straightened
   d. Substantial, replacement parts needed for repair
   e. Cannot be repaired FIG. 1 shows sign panel 20 in a deployed or fully expanded configuration. Two or more arm assemblies 24 span the corners of panel 20 to hold the panel in a preferred planar configuration. The arm assemblies may comprise a pair of rigid aluminum ribs, or alternatively a pair of fiberglass ribs, as is known in the art. Other types of materials may also be employed as well. As an alternative, the arm assemblies may be formed separate one from another and joined at the center to align the arms in a co-planar arrangement, so as to provide a suitable support surface for the flexible panel 20. A central hub assembly is indicated at 26. Together, the arm assemblies 24 and center hub assembly 26 comprise a panel supporting system which, together with the sign panel 20 comprise panel assembly 12. With the sign panel assembly in a fully opened position, panel 20 is maintained relatively taut, and is thus subject to naturally occurring or vehicle induced wind bursts. These forces are applied to a support tube or upright 30. If desired, one or more arms 24 can span the vertical extent of panel 20, with support tube 30 being coupled to the arm at a point adjacent the bottom of panel 20. Alternatively, support tube 30 may be extended to the top of panel 20, with its upper portion functioning as the vertical support arm(s) 24.

A bottom portion 32 of support tube or upright 30 is fitted to a sign stand assembly 14. With additional reference to FIG. 2, sign stand assembly 14 includes a support tube 36 which is joined to an upright 30 to impart support thereto the preferred embodiment, support tube 36 is hollow, with a central passageway dimensioned to receive the bottom portion of upright 30. The upright 30 is secured within the upper portion of support tube 36 by bolt fasteners 38. Alternative construction, may include an upright 30 which is telescopically received within support tube 36 and secured thereto with suitable adhesives or metallurgical joining such as welding or brazing. Alternatively, support tube 36 can be made to comprise the bottom portion of upright 30, eliminating the need for a special joining arrangement.

Figure 2:
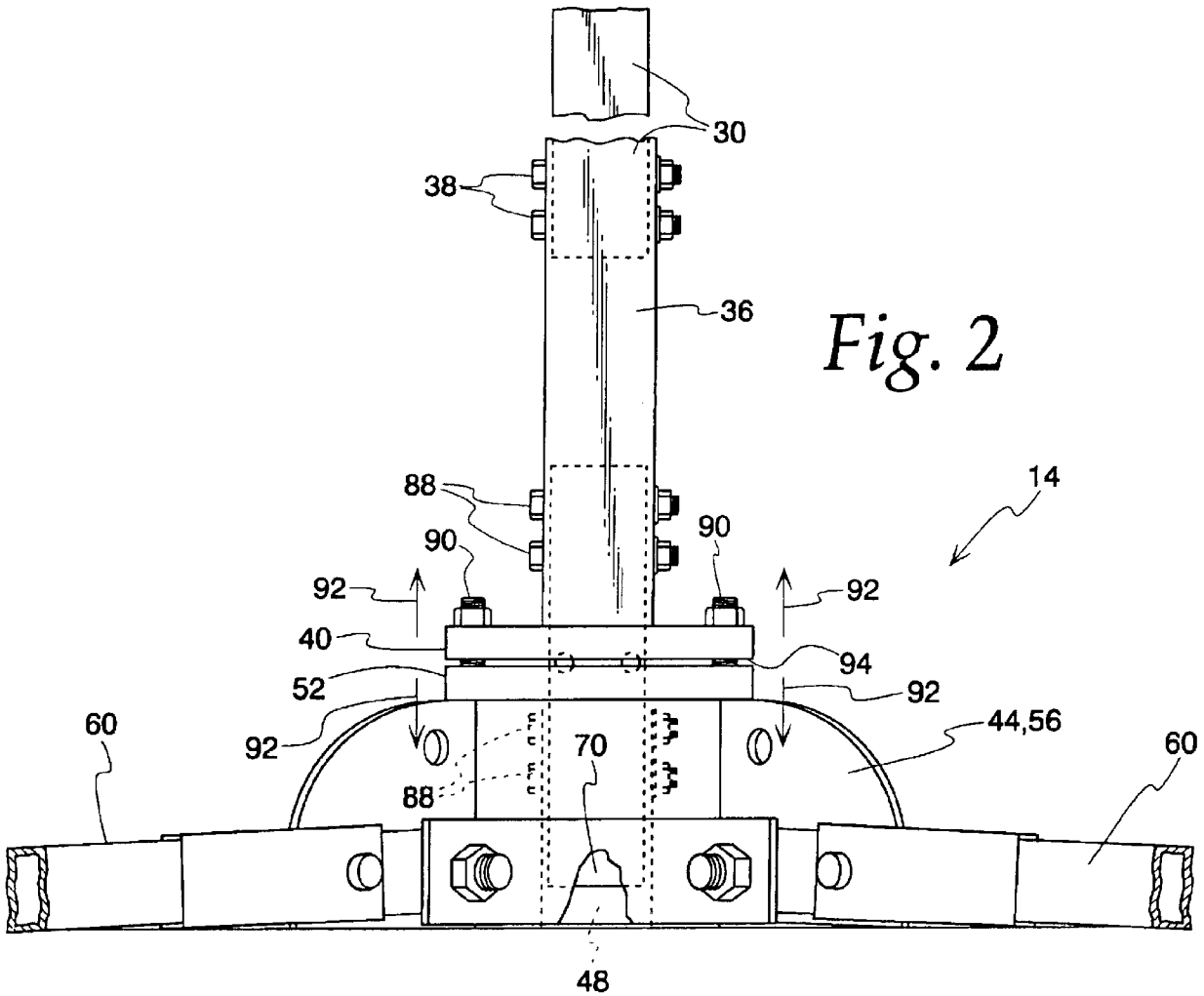
FIG. 2 is a fragmentary front elevational view of the sign stand assembly, taken on an enlarged scale.
Figure 3:
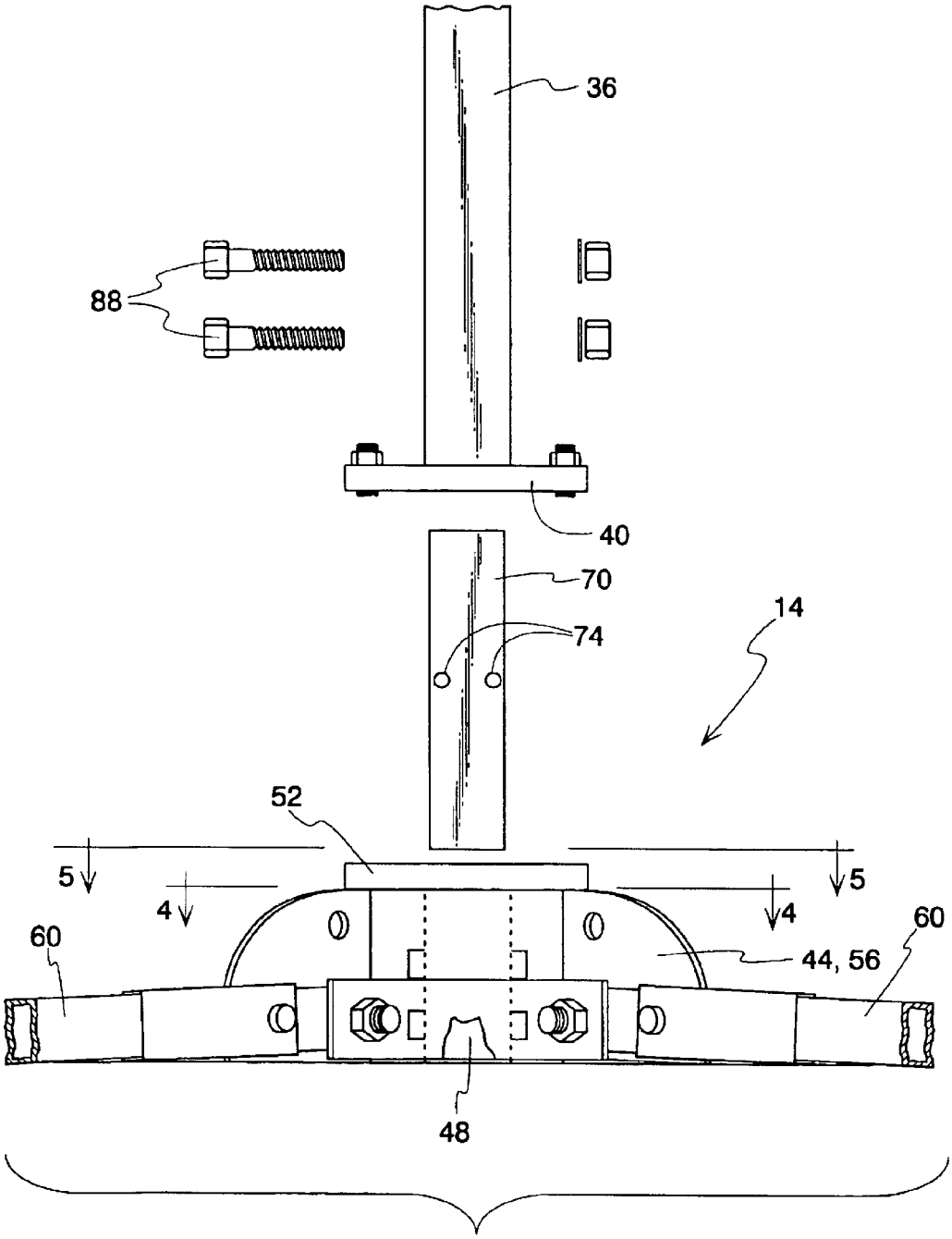
FIG. 3 is an exploded view thereof.

With reference to FIGS. 1–3 support tube 36 is joined to support plate 40. Preferably, support tube 36 is fitted within an aperture formed in plate 40, with the bottom edge of support tube 36 located adjacent the bottom major surface of support plate 40. Support tube 36 is joined to support plate 40 using conventional fastening means such as adhesive, shrink fit, brazing and most preferably welding. Together, support tube 36 and support plate 40 form a continuous rigid structure.

Figure 5:
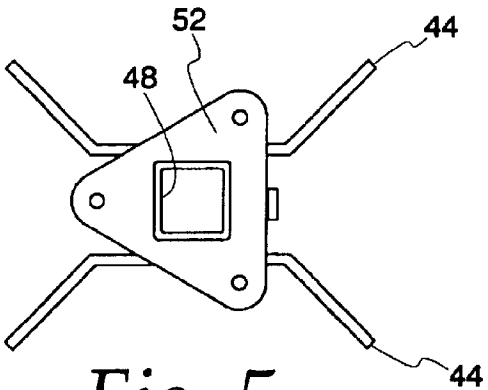
FIG. 5 is a cross-sectional view taken along the line 5—5 of FIG. 3.

Referring now to FIGS. 2–5, support assembly 14 includes a pair of opposed body plates 44 joined to an intermediate force accumulator tube 48. Preferably, force accumulator tube is hollow and is joined to body plates 44 using conventional means, such as welding. An optional outer support collar 46 may be employed to assist in the welding operations. For example, collar 46 may be welded between plates 44 with force accumulator tube 48 thereafter being welded to support collar 46. With reference to FIG. 5, force accumulator tube 48 is fitted within a base plate 52 and has an upper end preferably aligned adjacent the upper major surface of base plate 52. Force accumulator tube 48 and base plate 52 are joined together using conventional fastening means, such as welding. In a preferred embodiment, base plate 52 is also joined to bottom plates 44 preferably by welding. Accordingly, in a preferred embodiment base plate 52, force accumulator tube 48 and plates 44 comprise a unitary rigid assembly.

Figure 8:
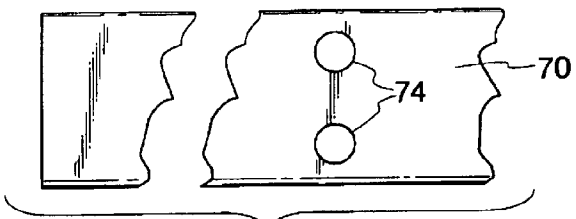

As indicated in FIGS. 2 and 3, plates 44 include outwardly diverging ears 56 each of which supports a ground-engaging leg 60 (see FIG. 1). Legs 60 have been omitted in FIGS. 4 and 5 for drawing clarity. A connecting tube 70 has an upper end inserted within support tube 36 and a lower end inserted within force accumulator tube 48. As can be seen in FIG. 3 the mid-portion of connecting tube 70 includes several weakening members 74 which are aligned in a plane generally perpendicular to the longitudinal axis of a connecting tube. In a preferred embodiment, the connecting tube, as with the support tube and force accumulator tube, have generally rectangular and most preferably square cross-sectional shapes. Connecting tube 70 has upper and lower portions dimensioned for a relatively close fit engagement with the support tube and force accumulator tubes, respectively. Accordingly, the connector tube 70 has four outer faces, one of which is visible, for example, in FIG. 3. Preferably, all four outer faces of connecting tube 70 have an identical appearance, that is, each face has a pair of weakening members 74. As illustrated in FIG. 3 and as can be seen in the enlarged drawings of FIGS. 8 and 11, weakening members 74 comprise round holes located toward the outside corners of the connecting tube, and being separated by an intervening wall portion of the connecting tube.

Figure 11:
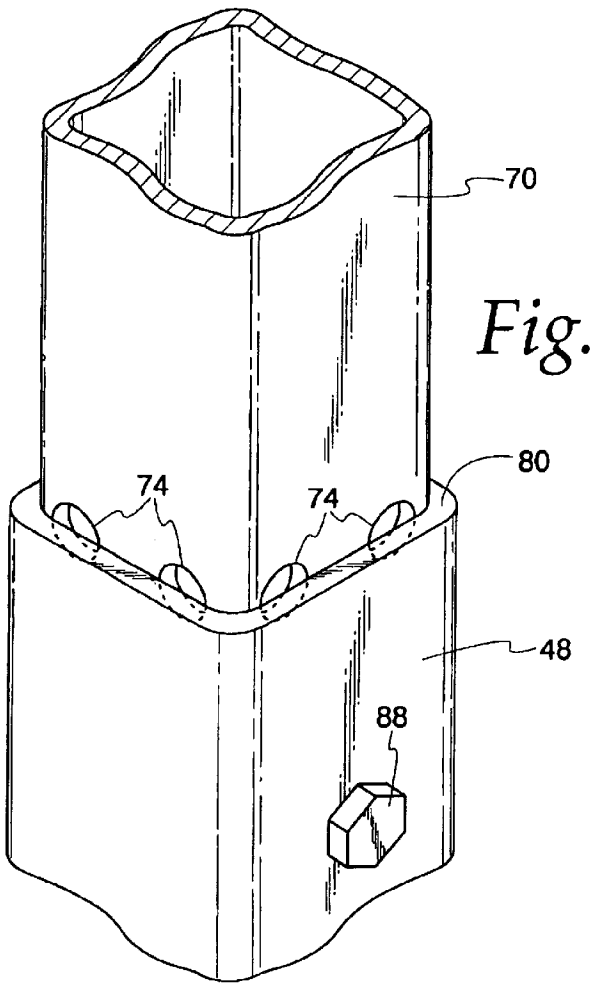
Figure 12:
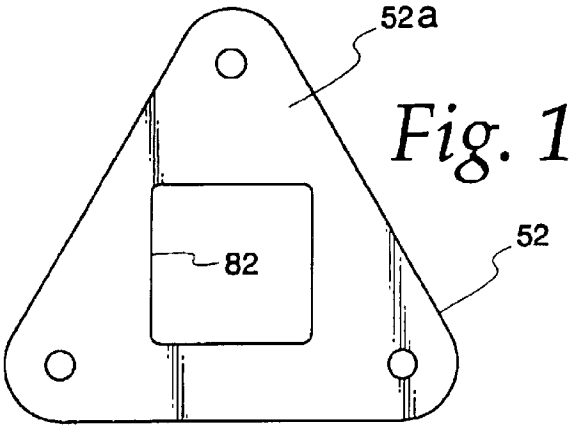

Referring again to FIG. 11, force accumulator tube 48 has an upper end surface 80 which, as mentioned, is generally aligned with the upper major surface of base plate 52. With reference to FIG. 12, base plate 52 has a central opening 82 for receiving the upper end of force accumulator tube 48. Preferably, opening 82 is dimensioned for a close tolerance fit with the upper end of the force accumulator tube. Preferably, the force accumulator tube 48 is rigidly joined to base plate 52 with a conventional joining means such as welding to maintain the upper edge 80 (see FIG. 11) of the force accumulator tube 48 with the upper surface 52*a* of base plate 52 (see FIG. 12). As shown in FIG. 11, connecting tube 70 is carefully aligned with respect to force accumulator tube 48, with a controlled insertion depth, such that the upper edge 80 of the force accumulator tube generally overlies only the lower half portions of weakening member 74. FIG. 11 shows the preferred relative alignment of the force accumulator and connecting tubes, although the relative alignment can be made to vary plus or minus one-half the vertical height of the weakening element as may be desired to "fine tune" the desired response for a particular installation.

With reference to FIG. 2, the upper and lower ends of connecting tube 70 are secured to support tube 36 and force accumulator tube 48, respectively by bolt-like fasteners 88. A plurality of threaded fasteners 90 extend between plates 40, 52 and are arrangement so as to apply a force tending to separate plates 40, 52 in the direction of arrows 92. Although not required, it is generally preferred that a gap 94 be formed between plates 40, 52. In a preferred embodiment, threaded fasteners 90 are threadingly engaged with support plate 40 and have lower ends receiving thrust support from the upper surface of base plate 52. As threaded fasteners 90 are advanced, support plate 40 is urged in an upward direction, away from base plate 52. Upward travel is restrained by connecting tube 70 which is joined at its upper and lower ends to the support tube 36 and force accumulator tube 48, respectively.

Figure 16:
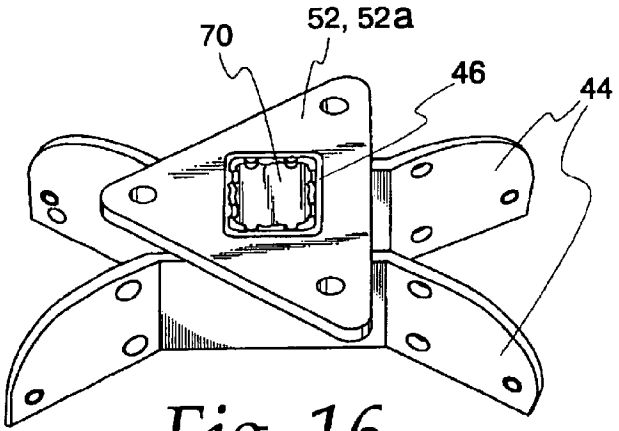
Figure 21:
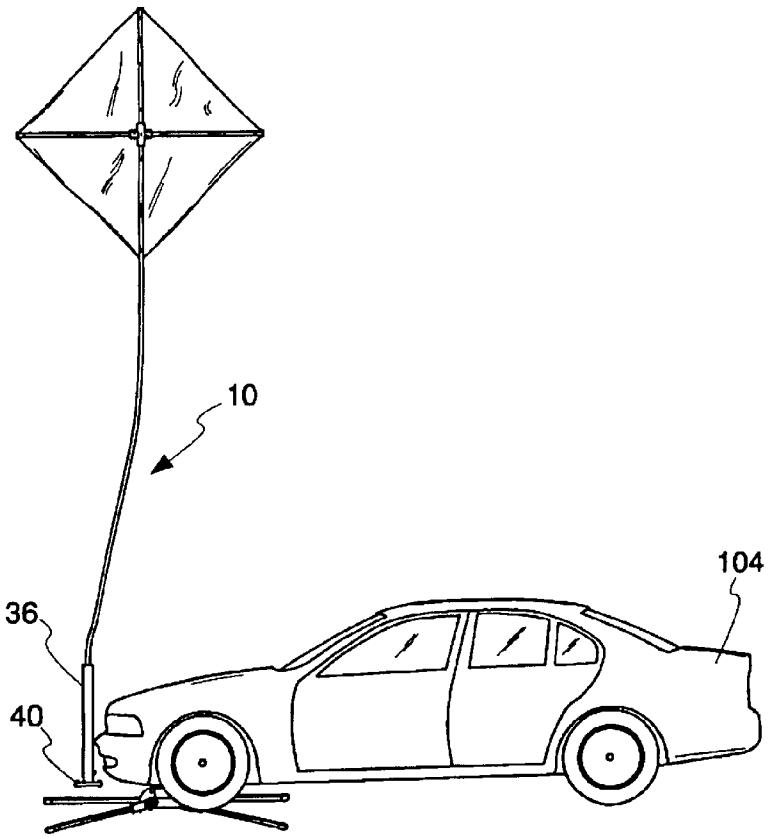
FIGS. 20–22 show the sign stand assembly during an impact event.
Figure 20:
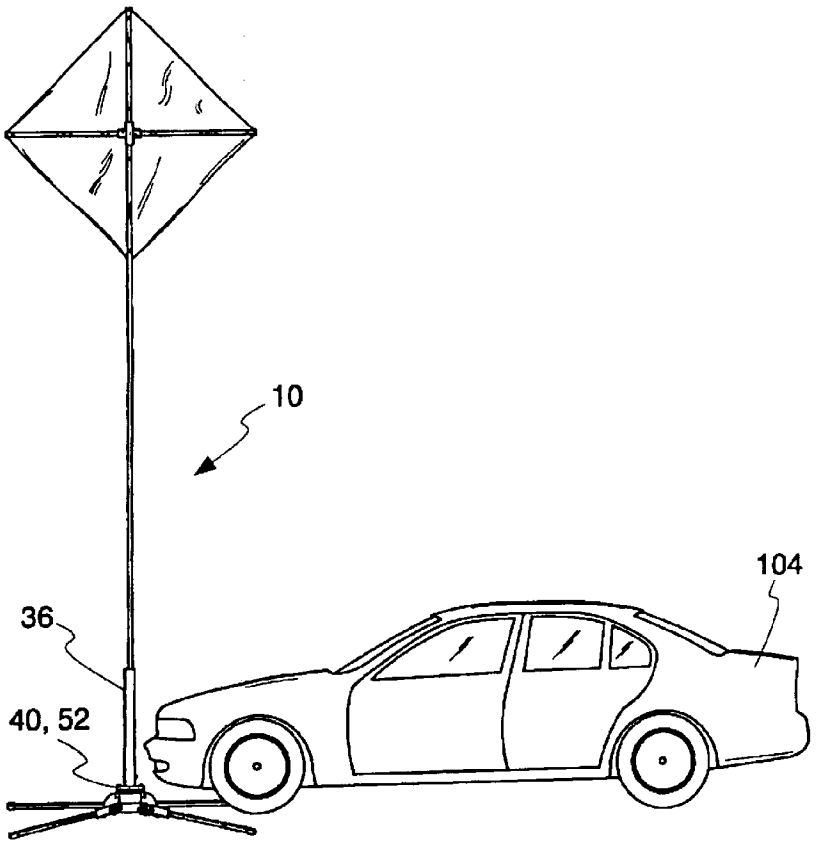
Figure 22:
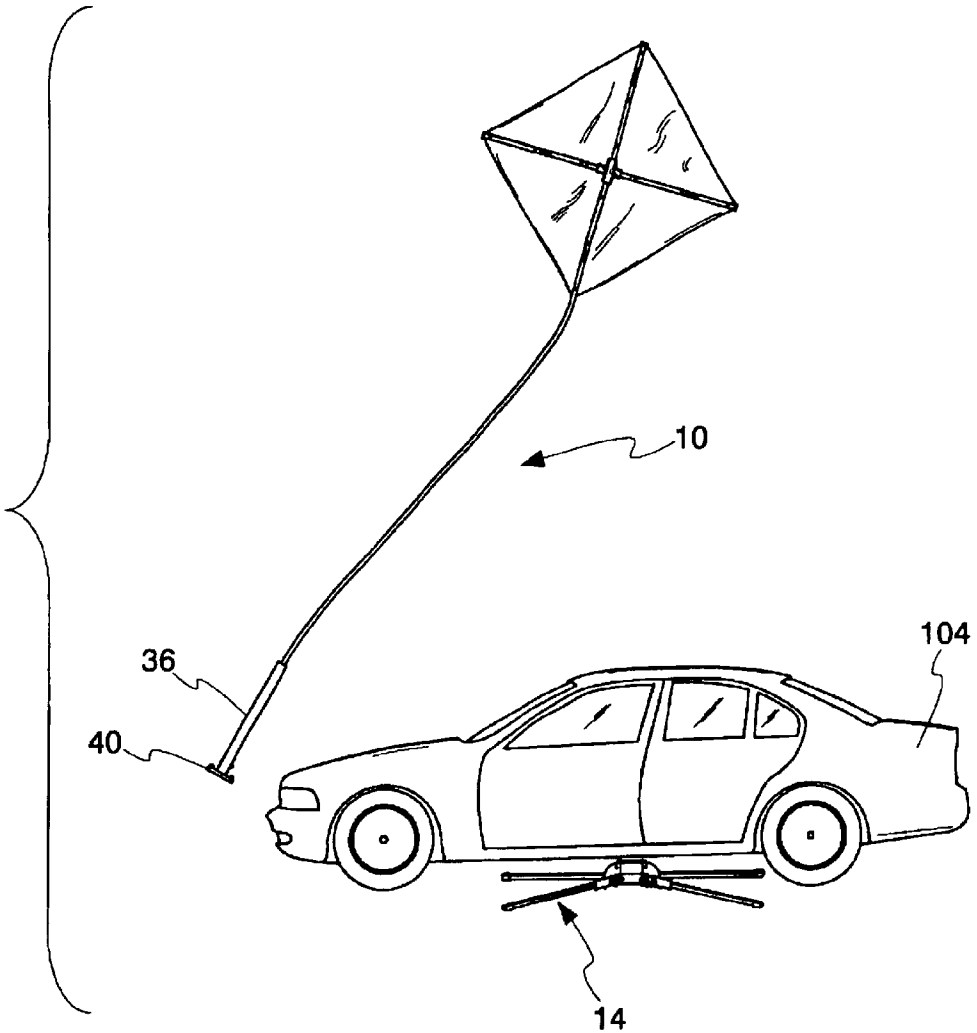
Figure 23:
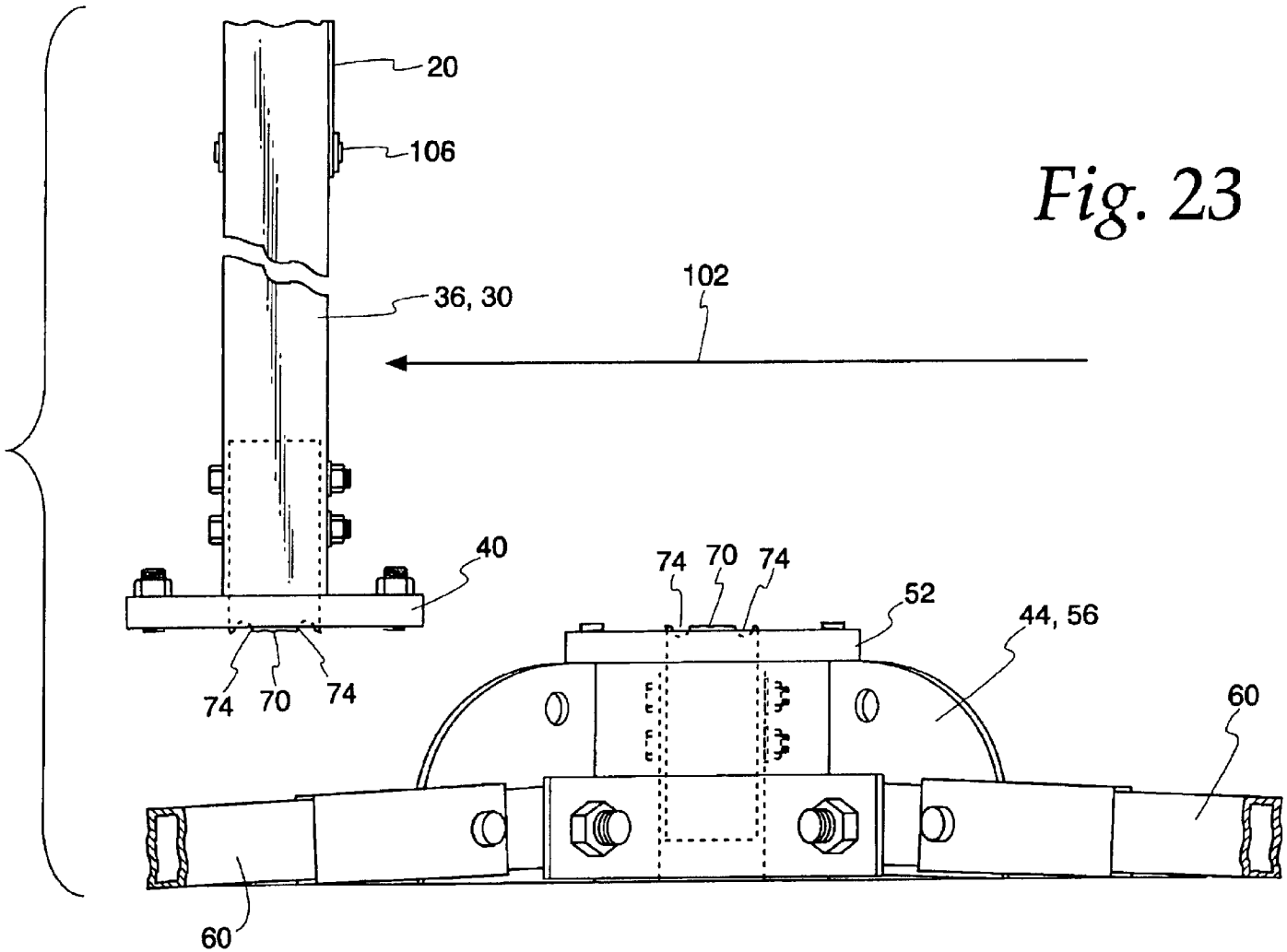
FIG. 23 is an enlarged fragmentary view of the sign stand assembly immediately after impact.

In the preferred embodiment, threaded fasteners 90 are advanced until a pre-determined tension load is placed on connecting tube 70. When subjected to an impact event as indicated by FIGS. 20–22, connecting tube 70 is ruptured in the manner indicated in FIGS. 16 and 23. In a preferred embodiment, the connecting tube has been observed to separate along an imaginary, generally horizontal plane located at or slightly above the upper surface of base plate 52. In FIG. 23, the direction of applied force is indicated by arrow 102 and, in the impact scenario indicated in FIGS. 20–23 it is aligned with the direction of travel of the illustrated vehicle 104. The sign assembly 10 illustrated in FIGS. 20–23 has a support tube 36 extending up to and at least slightly above the point of impact with vehicle 104, causing efficient transfer of lateral force to the region of weakening of connecting tube 70, defined by weakening member 74 and located generally in gap 94, at or between the opposed major faces of plates 40, 52. As mentioned, in an alternative embodiment, the support tube 36 and upright 30 of the sign panel assembly can comprise a continuous unitary member. As indicated in FIG. 23, panel 20 is secured by a conventional rivet fastener 106.

Tensioning of the connecting member 70 is believed to greatly enhance energy control or focusing during the impact event. The relatively clean planar rupturing of the connecting member at or slightly above the upper surface of the base plate was observed even with ground engaging legs which are unrestrained and free to travel in a sideways direction, for example. Without the invention herein, as the sign stand travels in a lateral direction, the base rocks or twists altering modes of energy absorption during the critical initial portion of the impact event, which typically occurs in less than a second. It is important during this critical time in the impact event that impact forces be efficiently transferred into the sign stand, and transferred in an advantageous manner which causes the sign stand to rupture with the upper end of the sign stand directed along a path of movement which clears the vehicle windshield. Such important features are provided by the present invention. As indicated in FIG. 22, the support plate 40 has achieved a height generally aligned with the vehicle hood with the upper, freed portion of the sign stand accelerating in an upward direction while rotating in a clockwise direction, timed so as to bring the support plate 40 and support tube 46 above the path of travel of the vehicle windshield. In fact, as has been observed that with the present invention, the entire freed portion of the sign stand reacts to the applied impact force in a manner so as to clear vehicle 104 without making contact with the vehicle during or after the impact event.

Figure 6:
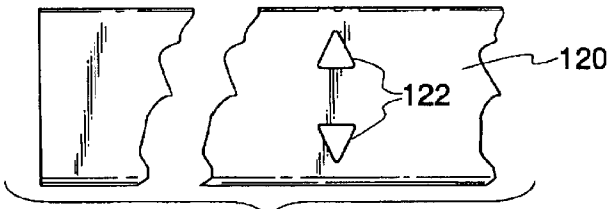
FIGS. 6–8 are fragmentary elevational views showing a connecting tube portion of the sign stand assembly.
Figure 9:
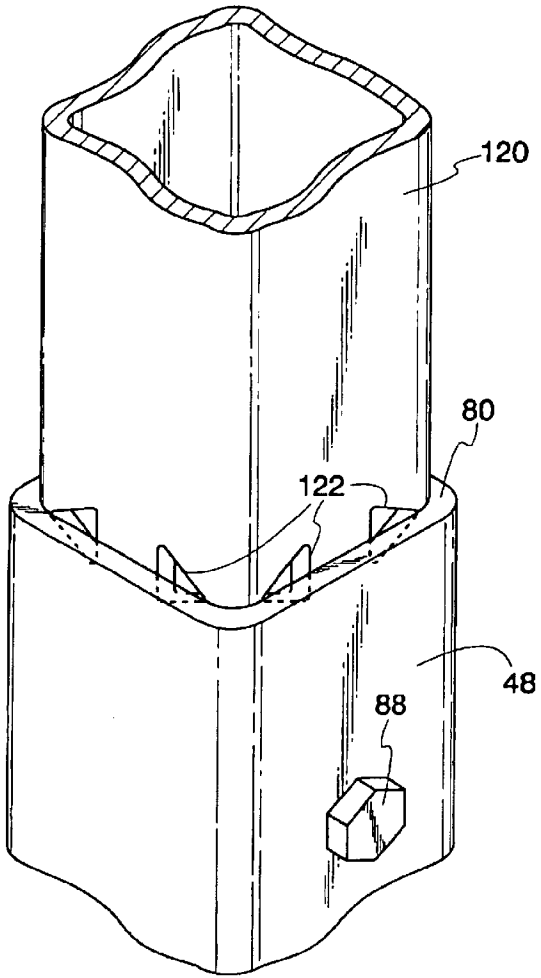

Referring now to FIGS. 6 and 9, an alternative connecting tube is indicated at 120. Connecting tube 120 is substantially identical to the connecting tube 70 described above, except that weakening members 122 have a generally triangular shape. As indicated, the triangular openings 122 are aligned along a common plane, generally transverse to the longitudinal axis of connecting tube 120. In a preferred embodiment, triangular openings 122 on a given face of the connecting tube point away from each other, toward outside corners of the connecting tube. As shown in FIG. 9, the upper edge 80 of force accumulator tube 48 is aligned with respect to weakening members 122 such that generally only the lower half of the weakening members is overlaid by force accumulator tube 48. As with other embodiments, relative orientation of the force accumulator tube and the connecting tube may be adjusted generally plus minus one-half the vertical height of the weakening members.

Figure 7:
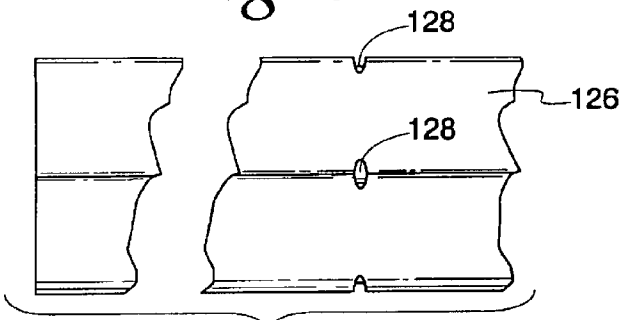
Figure 10:
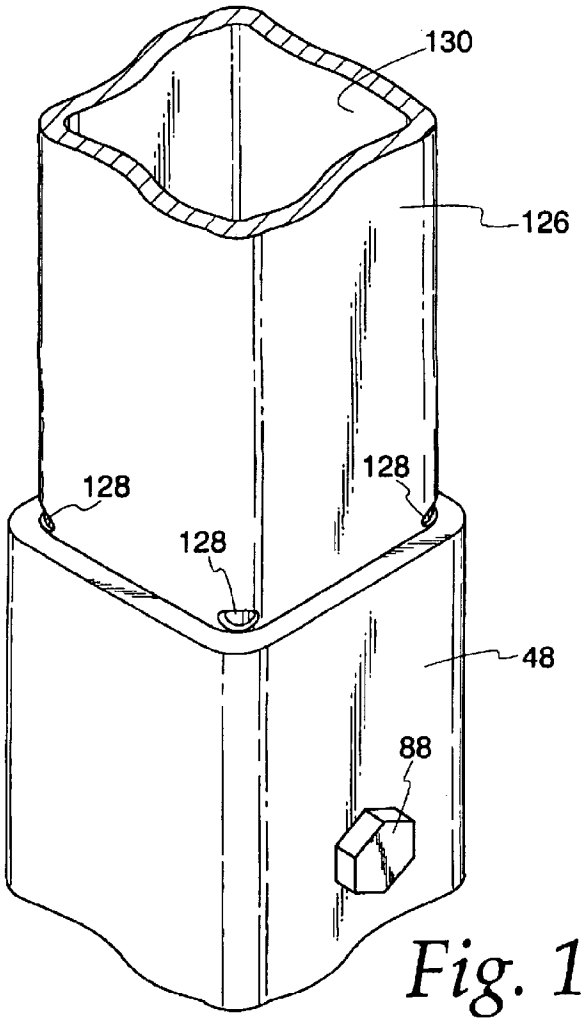
FIGS. 9–11 are fragmentary perspective views showing the connecting tubes to FIGS. 6–8 installed in the sign stand assembly.

With reference to FIGS. 7 and 10, connecting tube 126 has outside corners in which weakening members 128 are formed. Weakening members 128 generally comprise notches extending into the outside corners and are preferably aligned along a common plane generally perpendicular to the longitudinal axis of the connecting tube. Notches 128 extend below the outer surface of the connecting tube and most preferably extend through the walls of the hollow connecting tube penetrating the inner surface 130 (see FIG. 10).

Figure 13:
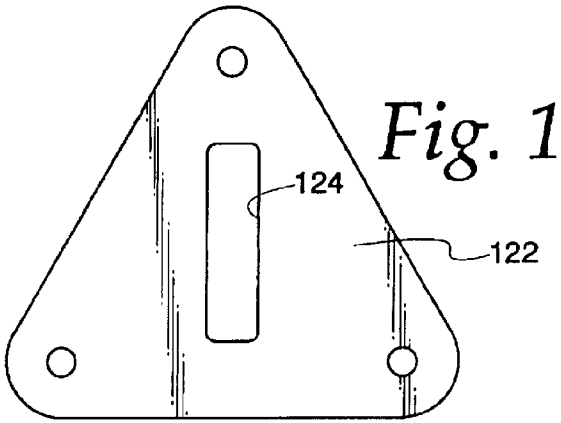
FIGS. 12–15 show alternative embodiments of base plate members of the sign stand assembly.
Figure 17:
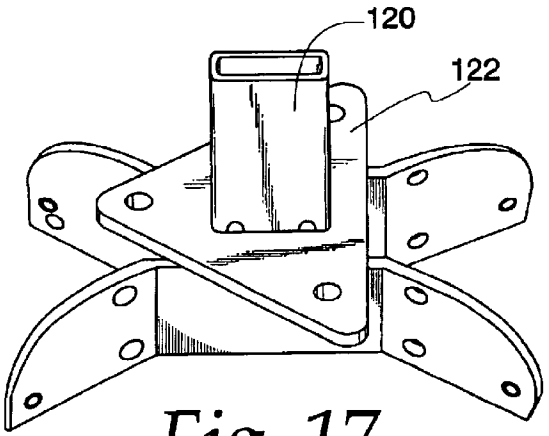
FIGS. 16–19 show the base plates of FIGS. 12–15 installed in a sign stand assembly.

Referring to FIGS. 13 and 17, an alternative embodiment of the connecting tube indicated at 120 has an elongated, rectangular, cross-sectional shape. Connecting tube 120 is received in a base plate 122 having an elongated rectangular opening 124 dimensioned for a tight fit with the connecting tube. Any of the weakening members described above may be employed. As a further example of optional weakening which may be employed with any of the embodiments disclosed herein, one or more "score" lines may extend into the surface of the connecting tube, preferably along a plane generally perpendicular to the longitudinal axis of the connecting tube. The "score" lines may be continuous or may be spaced-apart or "dashed".

Figure 14:
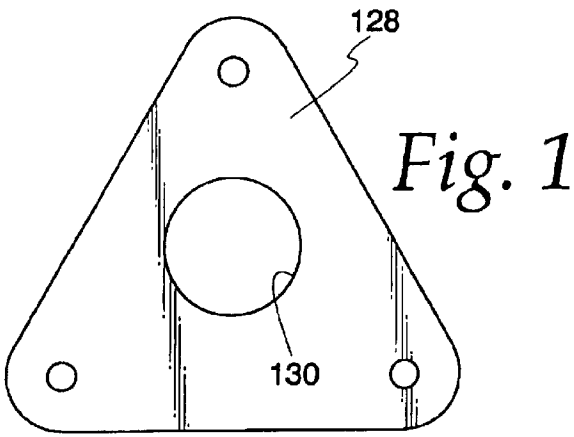
Figure 18:
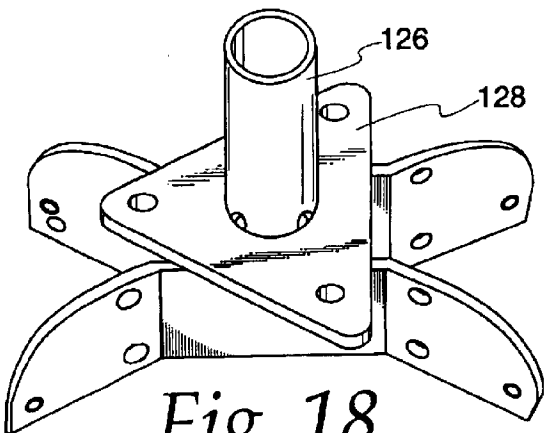

As shown in FIGS. 18 and 14 the connecting tube may have a generally cylindrical configuration as indicated at 126. The corresponding base plate 128 has a circular hole 130 to receive connecting tube 126 in a tight fit relationship.

Figure 15:
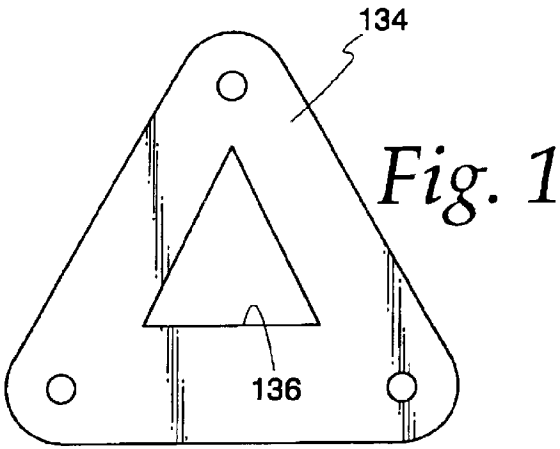
Figure 19:
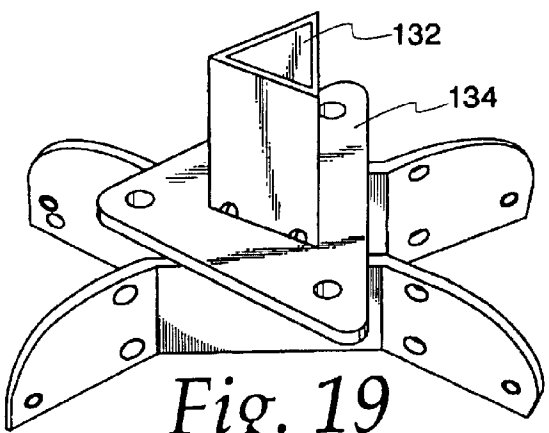

FIGS. 15 and 19 show an arrangement for a connecting tube having a generally triangular cross-section, as indicated at 132. A connecting tube is received in a triangular opening 136 formed in base plate 134 and is dimensioned for a telescopic fit with the connecting tube in a tight fit relationship. Any of the weakening members described herein may be employed with the alternative connecting tubes and their associated plates.

Figure 25:
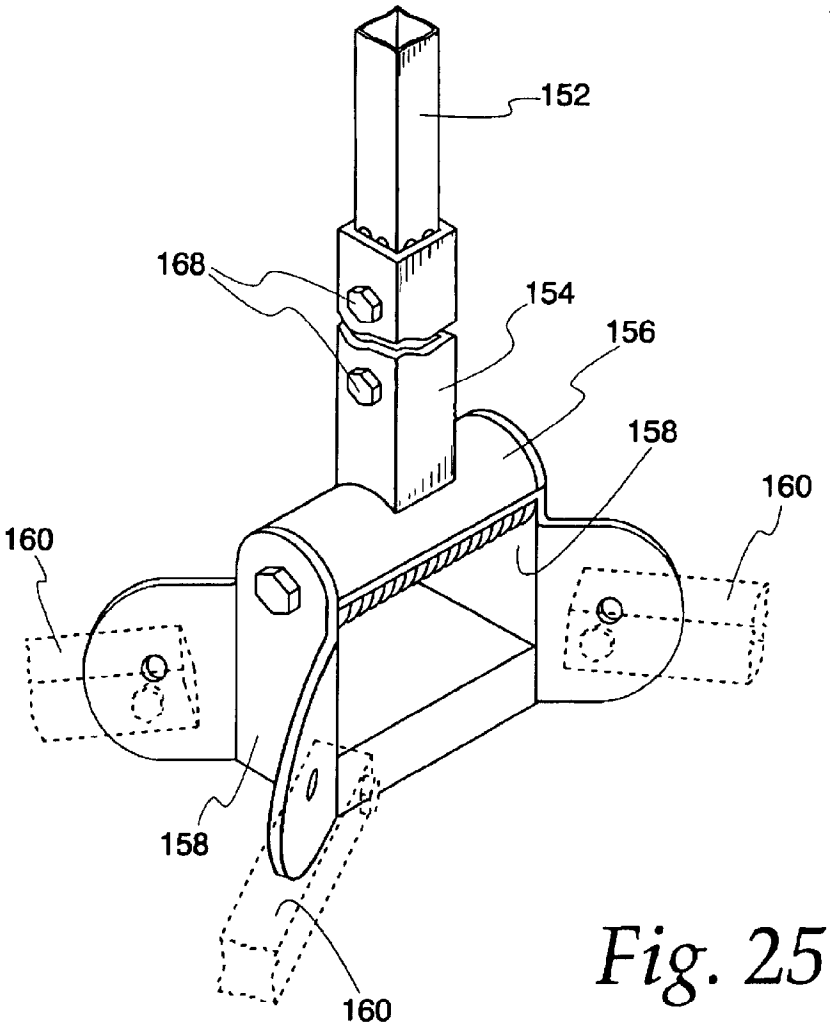
FIG. 25 is a fragmentary perspective view of a sign stand support of FIG. 24.
Figure 4:
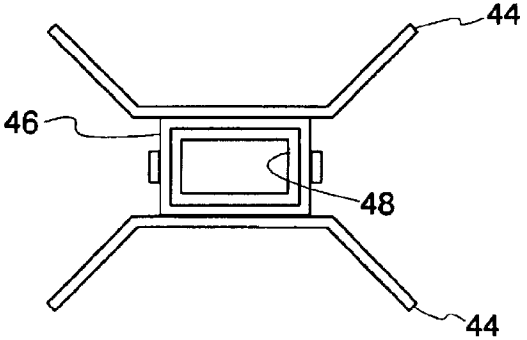
FIG. 4 is a cross-sectional view taken along the line 4—4 of FIG. 3.
Figure 24:
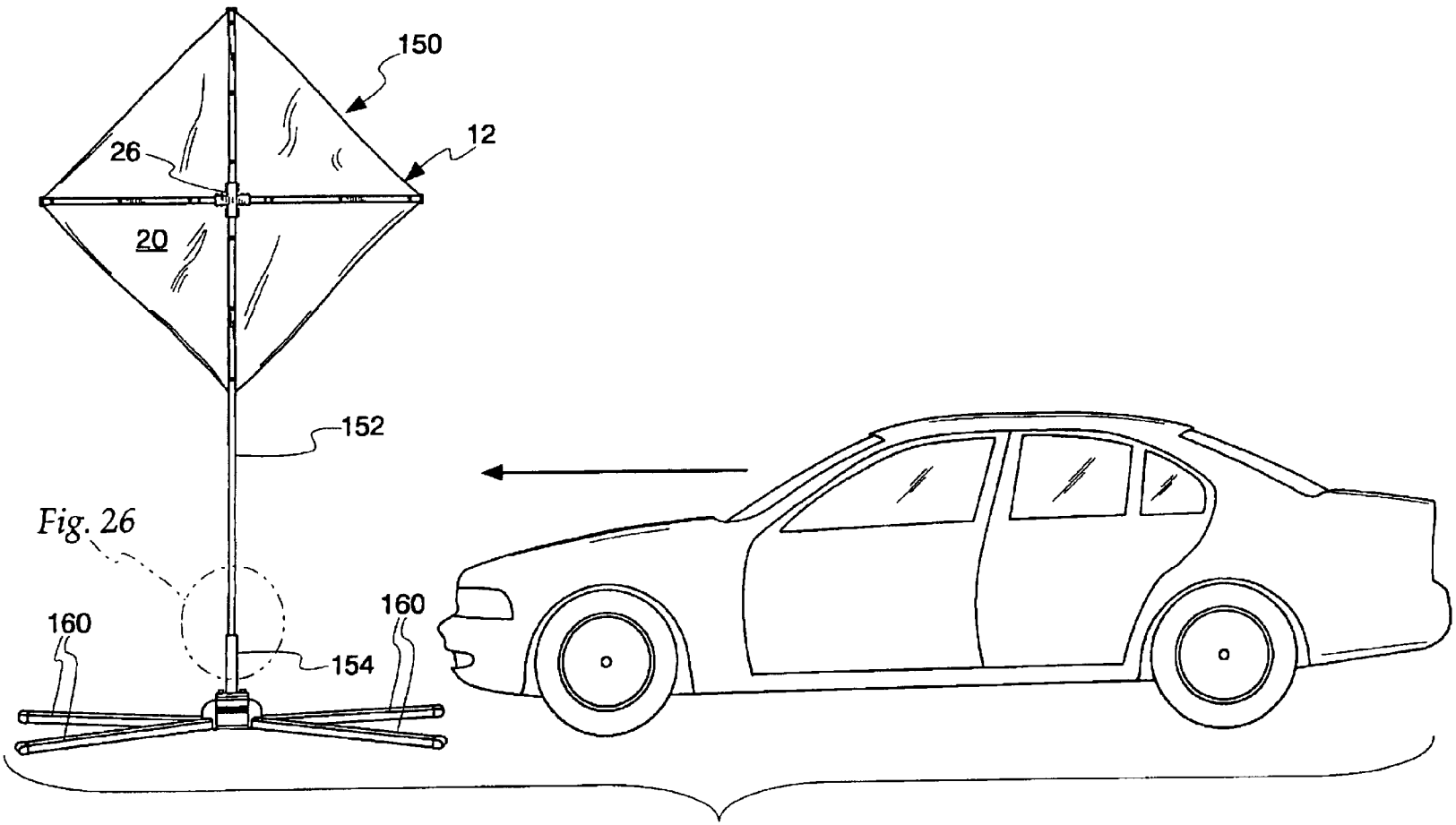
FIG. 24 shows an alternative embodiment of a sign stand assembly and sign stand, immediately prior to an impact event.
Figure 28:
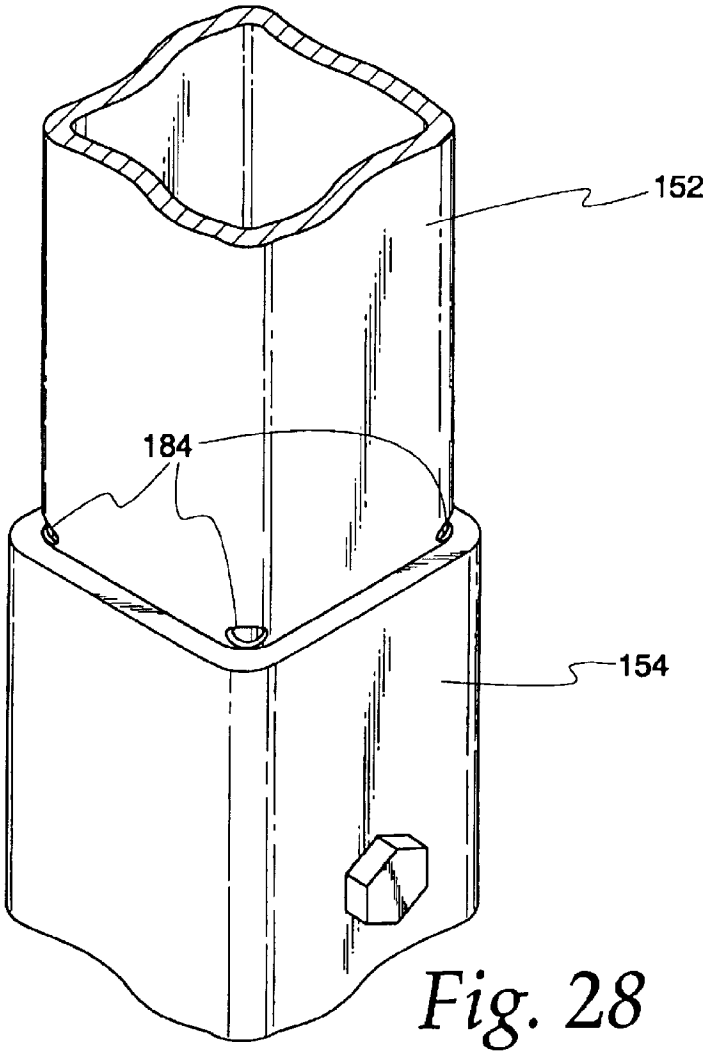

Turning now to FIGS. 24 and 25, an alternative sign arrangement is generally indicated at 150. Included is a sign panel assembly generally indicated at 12, as described above and an upright or support mast 152 received in a force accumulator tube 154. As can be seen with reference to FIG. 25, force accumulator tube 154 is supported on an upper saddle member 156 of a conventional spring-loaded sign supporting base of a type known in the art. Force accumulator tube 154 is preferably welded or otherwise rigidly joined to saddle member 156. The sign support base includes side plates 158 supporting ground engaging legs 160. If desired, force accumulator tube 154 can receive support in conventional ways other than the base having ground engaging legs. For example, a conventional ground socket can be provided for telescopic mating with the force accumulator tube, or the force accumulator tube itself could be used as a ground socket. Further, provision can be made in timbers, concrete pads, steel plates or other conventional expedients to support force accumulator tube 154 in a generally upright direction. Again, if desired, direct connection can be made to the force accumulator tube or a mounting socket for receiving the accumulator tube can be provided.

In a preferred embodiment, force accumulator tube 154 is resiliently mounted with respect to the sign supporting base so as to absorb wind energy, as is known in the art. Such torsional mountings have been employed to prevent wind bursts from causing the sign assembly to tip over or "hop" along the ground surface. The torsional mounting may be omitted, if desired.

The upright mast or support tube 152 may extend to the top of message panel 20 or may be coupled to vertical rib members at the central hub 26 or at some point therebelow, such as adjacent the bottom of sign panel 20. Upright 152 is telescopically inserted within force accumulator tube 154, in the manner described above with respect to the aforementioned connecting tubes. The depth of insertion of upright 152 within force accumulator tube 154 is limited by threaded fasteners 168. With additional reference to FIG. 26, the depth of telescopic insertion is limited such that the upper edge 172 of force accumulator tube 154 is generally aligned with the mid-portion of weakening members 174. In the embodiment shown, weakening members 174 comprise round holes and the lower portion of upright 152 generally resembles connecting tube 70 and weakening member 74, described above. Alternative weakening members such as triangular members 180, four corner-located notch members 184, similar to weakening members 122 and 128 described above may also be employed, as well as other weakening members mentioned herein.

Figure 29:
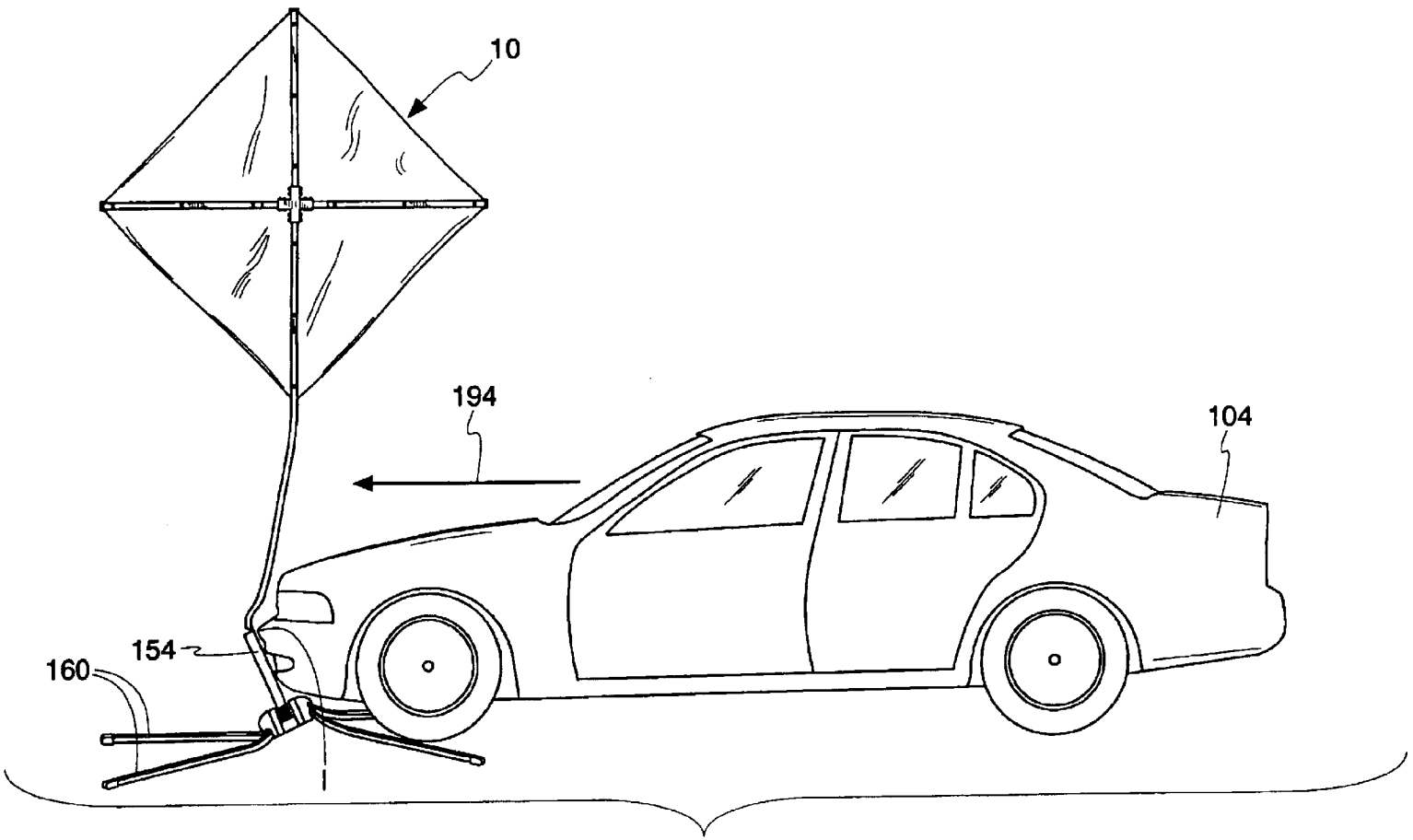
FIGS. 29 and 30 show the sign stand assembly during an impact event.
Figure 30:
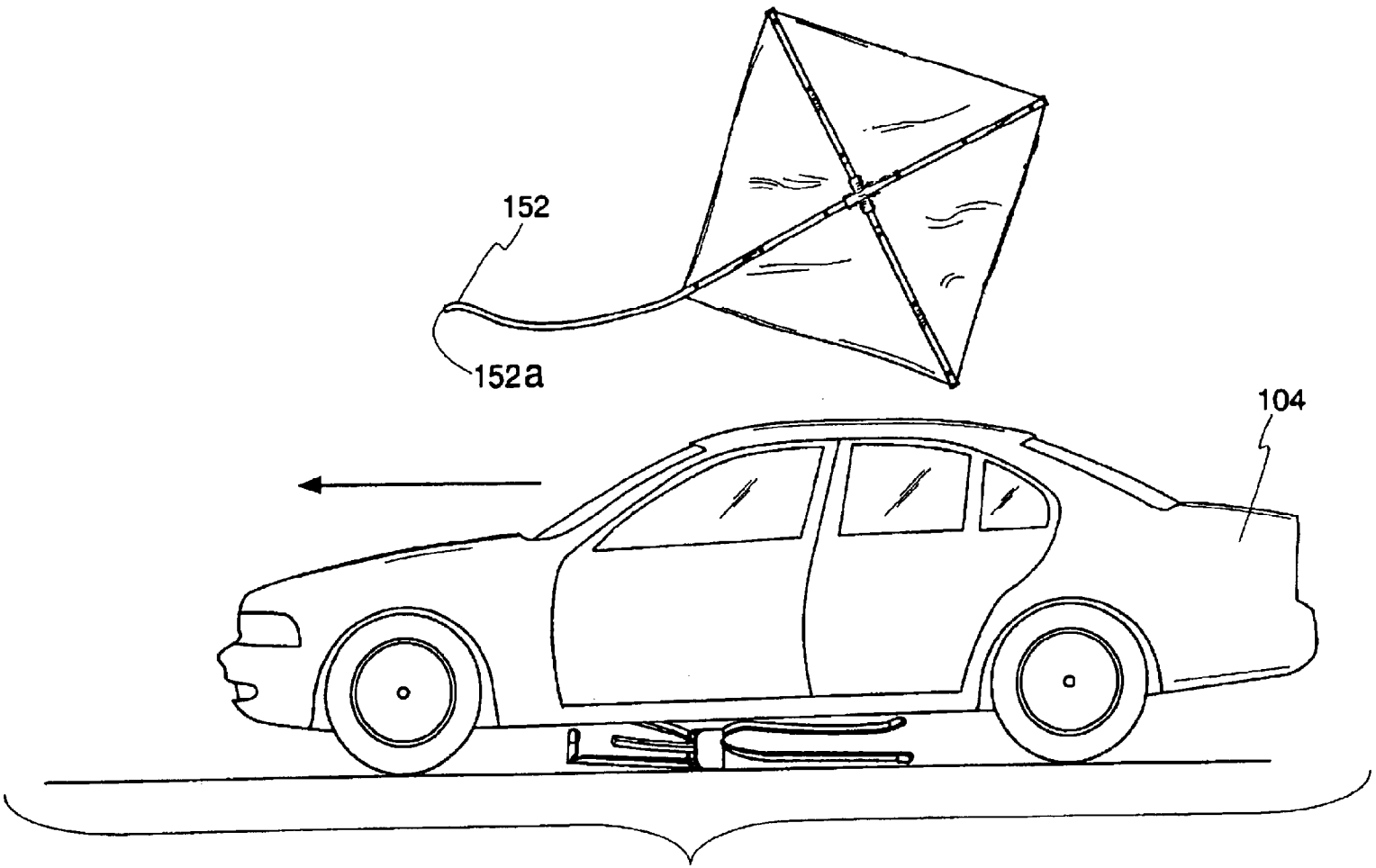

During the impact event shown in FIGS. 29 and 30, a lateral force is applied to the sign assembly by a vehicle 104 traveling in the transverse direction 194. As schematically indicated in FIG. 29, it is generally preferred that force accumulator tube 154 extend to the anticipated height of impact. This efficiently transmits lateral force to the sign assembly to cause a rapid response in the first fraction of a second impact, in which impact forces are efficiently transferred to the horizontal cross-sectional plane of the upright located at or near the horizontal plane containing the weakening members. Most preferably the rapid response includes rupturing of the lower portion of the upright, separation from the base and rotation in the manner indicated, all within 10 msec and most preferably within 3 msec.

With reference to FIG. 30, it has been observed that the lower free end 152*a* of upright 152 is formed by rupture of the upright along a plane located transverse to the longitudinal axis of the upright. It has further been observed that the planar rupture of the upright lies along or very near a transverse plane containing centers of the weakening members. As with the preceding embodiments, of the present invention, the upright is almost instantly ruptured and with further application of the impact force, the upper, freed portion of the sign assembly is caused to travel along a path of upward and clockwise (as shown in the figure) movement. The rotational movement moves the sign panel in a direction generally aligned with clockwise downstream movement of the vehicle, a motion which raises the ruptured, trailing end in an upward direction. It has been observed that the free end 152*a* is deflected as illustrated in FIG. 30 in a manner which clears the vehicle windshield.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A support arrangement, comprising:

a base plate;

a force accumulator tube of hollow predetermined cross-section depending from said base plate, said force accumulator tube having a free edge spaced from the base plate;

a support tube of hollow complementary cross-section, having a lower edge;

a support plate at the bottom of said support tube;

said support plate spaced from said base plate so as to form a gap therewith;

a tension arrangement extending between said base plate and said support plate, urging said base plate and said support plate away from one another;

a connecting tube having opposed ends telescopically engaged in a close-sized fit with said force accumulator tube and said support tube, respectively and spanning the gap between said support plate and said base plate;

said connecting tube further having a predetermined portion including a plurality of weakening members aligned with the free edge of said force accumulator tube; and alignment means cooperating with said force accumulator tube, said connecting tube and said support tube so as to align said plurality of weakening members with said force accumulator tube free edge;

whereby, a lateral force applied to said support arrangement is accumulated at the free edge of said force accumulator tube and is developed at said predetermined portion of said connecting tube.

2. The support arrangement of claim 1 wherein said support tube is inserted within said force accumulator tube.

3. The support arrangement, of claim 1 wherein said predetermined portion of said connecting tube including a plurality of weakening members aligned with the free edge of said force accumulator tube.

4. The support arrangement of claim 1 wherein said connecting tube is inserted within said force accumulator tube.

5. The support arrangement of claim 1 wherein said connecting tube is inserted within said support tube.

6. The support arrangement of claim 1 wherein said connecting tube is of constant cross-sectional size.

7. The support arrangement of claim 1 wherein said tensioning arrangement comprises elongate numbers threadingly engaged with one of said support plate and said base plate and receiving thrust support from the other said support plate and said base plate.

8. The support arrangement of claim 1 wherein said support plate and said base plate have thicknesses at least four times the thickness of said connecting tube and of said force accumulator tube.

* * * * *